US005266921A

United States Patent [19]

Wilson

[11] Patent Number: 5,266,921

[45] Date of Patent: Nov. 30, 1993

[54] METHOD AND APPARATUS FOR ADJUSTING VEHICLE HORNS

[75] Inventor: Carl R. Wilson, Texico, Ill.

[73] Assignee: Sparton Corporation, Jackson, Mich.

[21] Appl. No.: 828,239

[22] Filed: Jan. 30, 1992

[51] Int. Cl.[5] ..... G08B 3/00

[52] U.S. Cl. ..... 340/388; 340/384 E; 116/142 R

[58] Field of Search ..... 340/384 E, 388, 384 R; 116/142 R; 331/173; 381/192; 307/247.1; 310/317, 324; 29/593, 594, 609.1

[56] References Cited

U.S. PATENT DOCUMENTS 3,872,470 3/1975 Hoerz et al. ..... 310/317 X
4,813,123 3/1989 Wilson et al. ..... 29/593
5,049,853 9/1991 Yoon ..... 340/388

*Primary Examiner*—Jeff Hofsass
*Attorney, Agent, or Firm*—Reising, Ethington, Barnard, Perry & Milton

[57] ABSTRACT

Adjustment of the pulse energizing frequency and duty cycle of a vehicle horn is described. The horn is blown by a test energizing circuit with a varying pulse frequency and the and the frequency at which the horn produces the maximum sound pressure level is taken as the predetermined resonant frequency. Then the horn is blown by the test energizing circuit at the resonant frequency with a varying duty cycle value of duty cycle which produces a predetermined striking force of the plunger against the pole piece is taken as the predetermined impact-producing duty cycle which is used for setting the operating duty cycle of the horn in a manner depending upon the type of the horn. The horn is then blown by its own electronic energizing circuit and the actual pulse frequency thereof is adjusted, preferably by laser trimming of a resistor, to match the resonant frequency. Then the horn is blown by its own energizing circuit at the resonant frequency and the duty cycle is adjusted, preferably by laser trimming, to set the actual duty cycle in a known relation to the predetermined impact-producing duty cycle.

17 Claims, 3 Drawing Sheets

METHOD AND APPARATUS FOR ADJUSTING VEHICLE HORNS

FIELD OF THE INVENTION

This invention relates to the manufacture of vehicle horns; more particularly, it relates to method and apparatus for adjusting certain operating parameters of a vehicle horn having an electronic solid state energizing circuit.

BACKGROUND OF THE INVENTION

For many years, the electric horns commonly used on automotive vehicles have been of the type which generate sound by vibration of a diaphragm driven by an electromagnet motor. The horn typically comprises a housing with the diaphragm peripherally clamped thereto forming a motor chamber. The coil of the electromagnet is mounted within the chamber and a magnetic pole piece on the housing extends axially of the coil. A magnetic plunger on the diaphragm extends toward the pole piece for imparting motion to the diaphragm in response to periodic energization of the coil. The diaphragm provides a resilient suspension of the plunger for reciprocating motion relative to the coil; it has a spring characteristic whereby the diaphragm and the mass carried by it have a resonant frequency of mechanical vibration. The coil is energized from the vehicle battery through a mechanically actuated switch which is alternately opened and closed by movement of the plunger with the diaphragm. A vehicle horn of this kind is described in the Wilson et al U.S. Pat. No. 4,813,123 granted Mar. 21, 1989.

Vehicle horns of the type described above have been highly successful in meeting the needs of the automotive industry. However, it has been proposed to modify that type of horn by substituting an electronic solid state energizing circuit for the mechanical switching contacts. The mechanical switching contacts, in the horn described above, are operable by vibration of the diaphragm to alternately connect and disconnect the horn coil from the car battery so as to maintain the diaphragm in a state of vibration for generating the sound pressure waves of the horn. In the proposed use of an electronic solid state energizing circuit for the horn, the coil is energized from the car battery through an electronic switch which is alternately switched on and off by an electronically generated DC pulse train.

A vehicle horn which employs a solid state energizing circuit for the horn coil is disclosed and claimed in U.S. Pat. No. 5,049,853 to Y. S. Yoon granted Sep. 17, 1991 for "ELECTRIC HORN WITH SOLID STATE DRIVER" and assigned to the assignee of this application. In copending application Ser. No. 684,693 filed on Apr. 12, 1991 by Wilson et al, for "VEHICLE HORN WITH ELECTRONIC SOLID STATE ENERGIZING CIRCUIT" and assigned to the assignee of this application. The horn of application Ser. No. 684,693 has an energizing circuit in which the pulse repetition rate or frequency of the pulse train and the duty cycle of the pulse train are adjustable independently of each other. This permits setting of the pulse train frequency at a value which causes the diaphragm to vibrate at its resonant frequency and thereby obtain maximum sound pressure level output from the horn. It also permits adjustment of the pulse train duty cycle so as to set the amplitude of vibration of the diaphragm in relation to the impact or contact point between the plunger moving with the diaphragm and the fixed pole piece.

The vehicle horns of the type referred to above, with either mechanical switching contacts or electronic switching, are manufactured in two different sub-types. One sub-type commonly known as a "seashell" horn is provided with a resonant projector which generates sound by free vibration of the diaphragm. The resonant projector is a trumpet-like device comprising a spiral passageway which defines an air column of increasing cross-section from the inlet end at the diaphragm to the outlet end at a bell. A second sub-type of horn is commonly referred to as a "vibrator" horn. This horn is provided with a resonator which is a vibratory plate, usually of circular configuration, mounted at its center on the diaphragm and plunger. In this device, the horn is energized so that the plunger strikes the pole piece during each cycle of diaphragm motion and the force of the impact is transferred to the center of the resonator causing it to vibrate at its resonant frequency. The vibration of the resonator generates sound pressure waves which are propagated directly into the atmosphere without any intermediate coupling device.

The seashell horn and the vibrator horn produce distinctly different sounds. The vehicle is commonly provided with a pair of seashell horns or a pair of vibrator horns to produce a desired sound. One horn of each pair is designed for relatively low frequency and the other for high. For the vibrator horns this is typically 350 Hz and 450 Hz. For the seashell horns it is typically 400 and 500 Hz.

In such vehicle horns, it is desired to operate the horn so that the diaphragm is vibrated at its natural resonant frequency. This provides the maximum sound pressure level output from the horn for a given input power. Also, for the purpose of minimizing the power required to drive the horn, it is desired to have the air gap between the plunger and the pole piece at a minimum value consistent with the desired vibrational motion of the diaphragm. For a seashell horn, there is free vibrational motion of the diaphragm, i.e. without any physical contact of the plunger with the pole piece; on the other hand, in the vibrator horn, the vibrational motion of the diaphragm is limited by the impact of the plunger with the pole piece during each cycle of diaphragm vibration. To achieve this, the stroke length of the plunger must be correlated with the length of air gap which exists between the plunger and pole piece when the diaphragm is at rest.

It has been a common practice in the manufacture of vehicle horns of the type described above with an electromagnet driven diaphragm to set the air gap between the plunger and pole piece at a determined length, within manufacturing tolerances, during fabrication of the horn. After assembly, the horn is tested and, if necessary, certain adjustments are made. One of the tests, sometimes called the "buzz point" test is used to determine whether the horn produces a desired sound quality over the full range of voltage variation likely to be encountered in vehicle operation. In such horns provided with a mechanical switch contact, the voltage applied to the horn for this test is increased from a value below the rated voltage to a value higher than the rated voltage and the horn is checked audibly for a "buzz point" voltage. This buzz point voltage is that a which undesired striking of the plunger against the pole piece occurs. In the seashell horn no striking is desired and in the vibrator horn a striking with moderate force is desired. An adjusting screw is provided on the switch contacts and is adjustably positioned to increase or decrease the time duration of voltage applied to the horn coil. If the switch contacts can be adjusted so that the buzz point does not occur when the applied voltage is less than the upper limit of the specified operating range of voltage and, if the current drawn by the horn is not excessive, the horn is acceptable.

In the manufacture of horns with an electronic energizing circuit, as distinguished from mechanical switching contacts, the frequency and duty cycle of the energizing pulses applied to the horn coil must be set at values for each horn which will produce the desired performance in respect to sound pressure level and sound quality.

A general object of this invention is to provide a method and apparatus for adjusting the frequency and duty cycle of a horn having an electronic energizing circuit.

SUMMARY OF THE INVENTION

In accordance with this invention, a vehicle horn having an electronic energizing circuit is adjusted after fabrication for operation at its resonant frequency and at a duty cycle to produce a predetermined sound quality. The invention provides for production line testing of each individual horn and horn parameter adjustments in high volume production.

Further, in accordance with this invention, the horn is tested by a test energizing station to determine the resonant frequency of the horn and the operating duty cycle of the horn which produces the desired sound quality. Then, the horn is operated under control of its own electronic energizing circuit and the circuit is adjusted to match the energizing pulse frequency with the predetermined resonant frequency and to match the duty cycle with the predetermined operating duty cycle.

Further, in accordance with this invention, the horn is tested by energizing it with a variable frequency, variable duty cycle pulse generating circuit which is operated in a sweep or variable frequency mode at constant duty cycle to determine the resonant frequency by detecting the frequency at which the maximum sound pressure level is achieved. Then, the pulse generator is operated in a variable duty cycle mode at the resonant frequency to determine the minimum duty cycle at which the horn plunger strikes the pole piece with a predetermined striking force in order to set the operating duty cycle for the horn.

Further, in accordance with the invention, the pulse frequency of the horn energizing circuit is adjusted, preferably by laser trimming of a resistor, to set the frequency equal to the resonant frequency and subsequently the duty cycle is adjusted, preferably by laser trimming of a resistor, to set the duty cycle equal to the operating duty cycle.

A complete understanding of this invention may be obtained from the detailed description that follows, taken with the accompanying drawings.

BEST MODE FOR CARRYING OUT THE INVENTION

Figure 1:
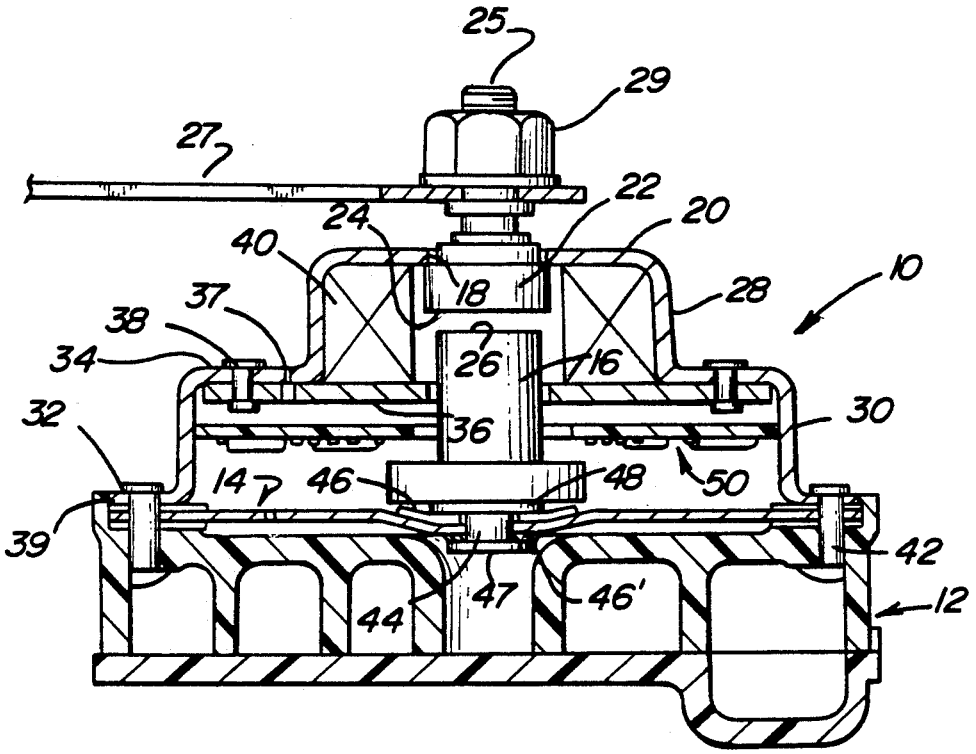
FIG. 1 is a cross-sectional view of a seashell vehicle horn having an electronic energizing circuit.

Referring now to the drawings, there is shown an illustrative embodiment of the invention in a method and an apparatus for adjusting the frequency and duty cycle of an electronic horn of either the seashell or vibrator type. It will be appreciated as the description proceeds, that the invention may be used with other types of horns and may be realized in different embodiments.

Electronic Vehicle Horns

FIG. 1 shows a vehicle horn of the seashell type which may be tested and adjusted in accordance with the subject invention. It has a metal housing 10 secured to a plastic projector 12. A spring steel diaphragm 14 is clamped at its margin between the housing 10 and projector 12 and is attached at its center to a ferromagnetic plunger 16. An aperture 18 in an end wall 20 of the housing 10 holds a pole piece 22 which extends toward the plunger 16. An end face 24 of the pole piece 22 is spaced from an end face 26 of the plunger 16 by a small air gap. The opposite end 25 of the pole piece 22 is threaded to receive a mounting bracket 27 and a securing nut 29.

The housing 10 is stepped to define a small end portion 28 including the end wall 20, and a larger portion 30 terminating in a radial flange 32 for supporting the diaphragm. An intermediate generally planar annular portion 34 interconnects the small end portion 28 and the larger portion 30. An electromagnetic coil 40 fits within the small end portion 28 and surrounds adjacent ends of the plunger 16 and the pole piece 22. An annular mounting plate 36 secured to the intermediate portion 34 by rivets 38 retains the coil in the end portion 28. The plate 36 is apertured to accommodate the plunger 16 for free movement therein.

The diaphragm 14 is mounted on the flange 32 of the housing between annular gaskets 39 which conform to the diaphragm margin. The projector presses the gaskets 39 and diaphragm 14 against the flange 32 and fasteners 42 secure the assembly. The plunger 16 has a stem 44 of small diameter protruding through the diaphragm at its center and through a pair of washers 46 and 46', one on each side of the diaphragm. The stem defines a shoulder 48 which engages one washer 46 and the other washer 46' engages a head 47 on the stem, thereby securing the diaphragm and the plunger for movement as a unit. The combined mass of the diaphragm 14 and the plunger 16 along with the spring rate of the diaphragm determine the resonant frequency of the diaphragm assembly. The coil 40 is energized from the vehicle battery by the solid state energizing circuit which is provided on a circuit board 50. The circuit board can be located either inside or outside the housing. In the illustrative embodiment, the circuit board is suitably mounted on the plate 36 inside the housing and is electrically connected by external horn terminals (not shown) to the vehicle battery and to the horn switch. The housing 10 is provided with a one or more small openings 37 (one shown) which are suitably placed to permit laser trimming of resistors on the circuit board after assembly of the horn. After the resistor trimming, to be described below, the holes are filled to close the housing. The sound produced by the horn is transmitted by the projector 12 which is tuned to the resonant frequency of the plunger/diaphragm assembly. The mechanical aspect of the horn is described in further detail in U.S. Pat. No. 4,361,952 issued to James Neese, which is incorporated herein by reference.

Figure 2:
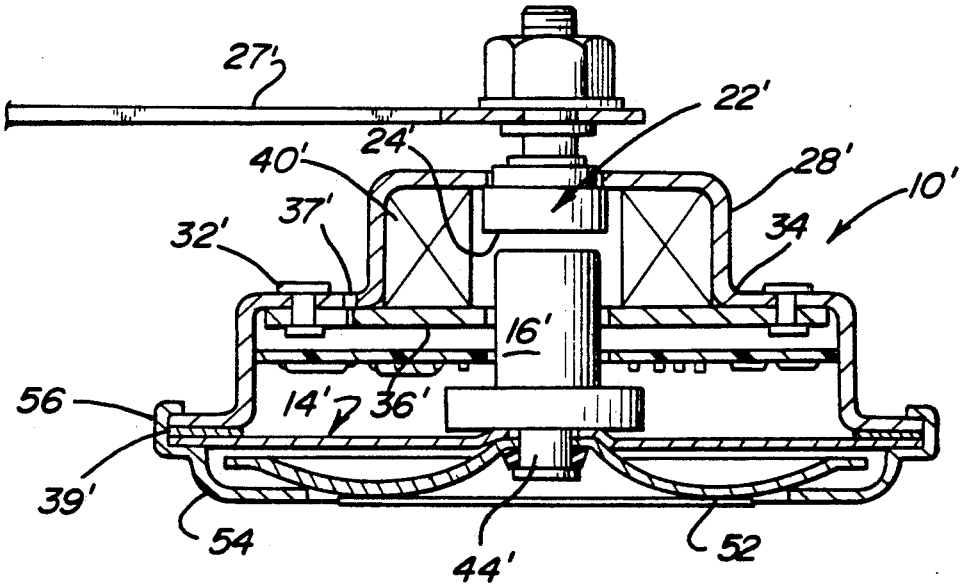
FIG. 2 is a cross-sectional view of a vibrator vehicle horn having an electronic energizing circuit.

FIG. 2 illustrates a vehicle horn of the vibrator type which may also be tested and adjusted in accordance with the subject invention. This horn is of the same type of construction as the seashell horn of FIG. 1 except that the plastic projector 12 of FIG. 1 is omitted and a resonator plate 52 is carried by the diaphragm 14'. The stem 44' on the plunger 16' protrudes through the center of the diaphragm 14' and resonator plate 52 and is provided with a head which secures the plate and diaphragm tightly on the plunger. An annular ring 54 has a peripheral flange 56 which clamps the periphery of the diaphragm to the flange 32' of the housing with a gasket 39' therebetween.

In this vibrator horn, the combined mass of the diaphragm 14', the plunger 16' and the resonator plate 52 along with the spring rate of the diaphragm determine the resonant frequency of the diaphragm assembly. As discussed above, this type of horn operates in such a manner that the plunger 16' physically strikes the pole piece 22' once, and once only, during each cycle of vibration of the diaphragm 14'. The force of the striking action is transmitted through the plunger 16' to the center of the resonator plate 52 and causes it to vibrate at or near its resonant frequency. The sound output from the horn is that generated by the vibration of the resonator plate 52, the sound waves being coupled directly from the resonator plate to the surrounding atmosphere.

Electronic Horn Energizing Circuit

Figure 3:
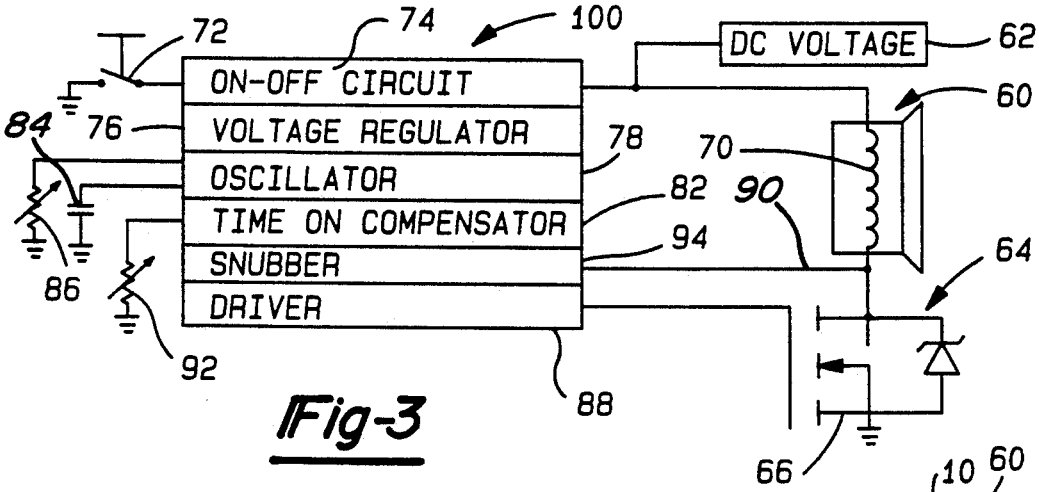
FIG. 3 is a block diagram of the electronic energizing circuit of the horns depicted in FIGS. 1 and 2.

Referring now to FIG. 3, the electronic horn energizing circuit of the horns of FIGS. 1 and 2 is shown in block diagram. In general, the energizing circuit comprises a control circuit 100 and a solid state power switch in the form of a power MOSFET 64. The circuit is shown for energizing a horn 60, which may be a seashell or vibrator horn, as it would be connected in an automotive vehicle. The horn 60 has its electromagnet coil 70 connected in series circuit with a DC voltage source 62 and the power MOSFET 64. More specifically, the power MOSFET 64 has its source 66 connected to ground and its drain 68 is connected through the coil 70 to the positive terminal of the voltage source 62, through an unswitched power circuit, the negative terminal of the voltage source being connected to ground. The horn switch 72 which is manually actuable by the vehicle driver, has its fixed contact connected directly to ground and its movable contact connected through an on/off circuit 74 to the positive terminal of the voltage source 62. When the horn switch 72 is closed, the battery voltage is applied by the on/off circuit 74 to the input of a voltage regulator 76. The voltage regulator 76 supplies a regulated supply voltage for an oscillator 78 and a time on or duty cycle compensator 82. The oscillator 78 is a sawtooth oscillator having an output frequency determined by a capacitor 84 and an adjustable resistor 86. The duty cycle compensator 82 develops a control signal which is combined with the output of the oscillator 78 to generate a pulse train which is applied to the driver stage 88. The control signal produced by the duty cycle compensator 82 determines the duty cycle of the pulse train and is adjustable by an adjustable resistor 92. The pulse train output of the driver stage 88 is applied to the gate 90 of the power MOSFET 64 which is switched on and off by the pulse train. A snubber 94 is connected from the drain to the gate of the power MOSFET to protect the circuit from transients.

The horn energizing circuit shown in FIG. 3 may be provided with a control circuit 100 as disclosed in detail in co-pending Ser. No. 684,693 referred to above, the entire disclosure of which is hereby incorporated by reference.

In accordance with this invention, the frequency and duty cycle of the horn control circuit 100 are adjusted as a part of the manufacturing process. The method and apparatus for adjusting the frequency and duty cycle will now be described with reference to FIGS. 4 and 5.

Frequency and Duty Cycle Adjustment

Figure 4:
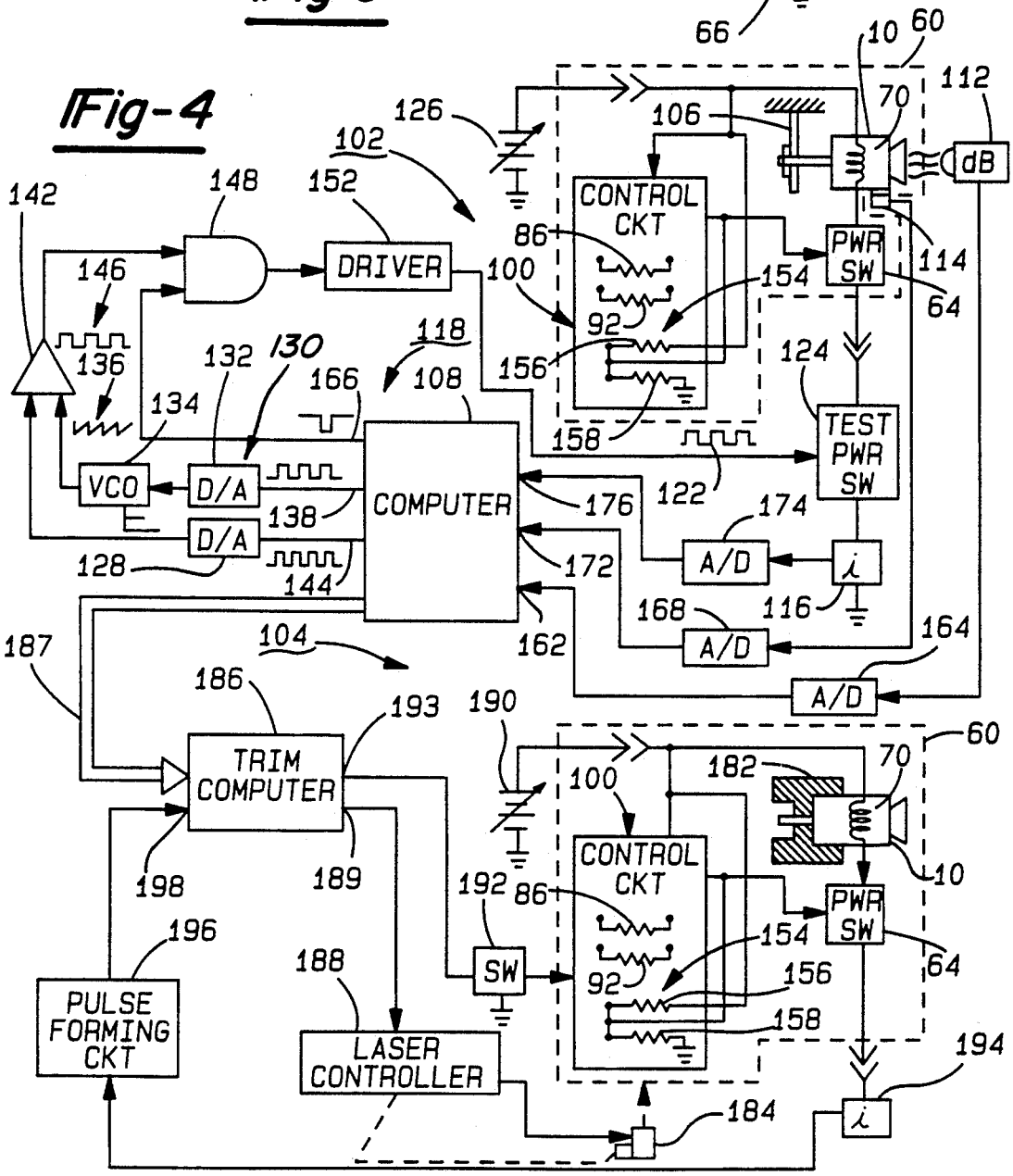
FIG. 4 is a diagram of the apparatus for testing and adjusting the electronic energizing circuit.

Referring now to FIG. 4, apparatus is shown with which the horn 60, either a seashell horn or a vibrator horn, is tested and adjusted after the horn is fully assembled. When the horn is assembled, the air gap between the plunger and the pole piece is set at a predetermined value within manufacturing tolerances. It remains to adjust the electrical parameters, namely the frequency and duty cycle of the switching pulse train which controls the switching of the solid state power switch, i.e. power MOSFET 64. This in turn controls the frequency and duty cycle of the pulse energization of the horn.

The apparatus of this invention comprises a testing station 102 and an adjusting station 104 as indicated in FIG. 4. The testing station 102, in general, operates to determine the resonant frequency of vibration of the diaphragm of the particular horn being tested and then it determines the maximum duty cycle at which that individual horn can be operated to obtain the desired quality of sound output. The testing station 102 may be adapted to test various classes of horns including, for example, low pitch seashell, high pitch seashell, low pitch vibrator and high pitch vibrator. In this illustrative embodiment, the testing apparatus 102 will be described for the example of a low pitch seashell horn which is designed to operate at resonant frequency of approximately 400 Hz. All of the horns of this class will have individual resonant frequencies which fall within a known frequency range, for example 425 Hz to 375 Hz; not all of the individual horns will have the same resonant frequency because of variations arising from manufacturing tolerances such as diaphragm thickness, for example. Additionally, the testing station 102 is operative to determine the maximum duty cycle for each individual horn within the class of horns being tested, i.e. low pitch seashells. This may vary from horn-to-horn due to variations arising from manufacturing tolerances such as the length of the air gap between the pole piece and plunger. It is known, however, that for all of the horns within the given class, the duty cycle will fall within a certain range of values, for example, between fifty-five and seventy-five percent for a low pitch seashell horn.

The Testing Station

The testing station 102 comprises a test fixture for holding the horn to be tested and it also includes an electronic system for subjecting the horn to certain tests. The horn 60 under test is depicted in FIG. 4 in a schematic fashion with the control circuit 100 being shown externally of the horn housing 10 and the power switch 64 being shown separately from the control circuit and the housing. The fixture for holding the horn 60 comprises a bracket arm 106 which mounts the horn in a manner similar to the mounting bracket 27 of a vehicle installation whereby the horn housing is free to vibrate in the same manner as in an actual vehicle installation.

The electronic system of the test station 102 comprises, in general, a computer 108 which receives input data from a set of sensors including a sound level sensor, i.e. a decibel (dB) meter 112, a vibration sensor, i.e. an accelerometer 114 and a current sensor, i.e. a current-to-voltage converter 116. The computer 108 is programmed to process the input data and produce outputs which control variable frequency, variable duty cycle pulse generator 118 which produces a pulse train 146 with adjustable frequency and with adjustable duty cycle. The pulse train 146 is applied to a driver 152 which produces a switching pulse train 122 for switching a test power switch 124. The switch 124 is switched alternately off and on to energize the horn coil 70 of horn 60 from the DC power source 126. The electronic test system will now be described in more detail.

The pulse generator 118 is adapted to operate in a variable frequency mode and in a variable duty cycle mode. For the purpose of determining the resonant frequency of the horn 60 under test, the pulse generator 118 is operated under the control of computer 108 to generate a sweep frequency which covers a frequency band known to include the resonant frequency of the horn under test. For example, for the low pitch seashell horn 60 under test, the frequency band may extend from 425 Hz to 375 Hz. For this purpose, a variable frequency oscillator 130 is provided with a variable duty cycle controller. The variable frequency oscillator 130 comprises a digital-to-analog (D/A) converter 132 and a voltage controlled sawtooth oscillator 134. The sawtooth wave output 136 of the oscillator 134 has a frequency which corresponds with the amplitude of voltage applied to the oscillator input from the D/A converter 132. The amplitude of the D/A output voltage corresponds with the pulse rate or frequency applied to its input from the computer output 138. The computer 108 operates to vary the pulse frequency at output 138 over a predetermined range such that the D/A converter 132 causes the voltage controlled oscillator 134 to sweep through the prescribed frequency band for the horn under test. Preferably the frequency sweep is executed from the higher frequency value to the lower value, for example, from 425 Hz to 375 Hz. The sweep frequency output wave 136 of the Voltage controlled oscillator 134 is applied to one input of a comparator 142. The other input of the comparator 142 receives the output of a D/A converter 128 which serves as the duty cycle controller. The output voltage level of converter 128 corresponds to the pulse frequency applied to its input from output 144 of computer 108. The comparator 142 produces the pulse train 146 of rectangular wave shape. The pulse train 146 has a frequency corresponding to the frequency of the sawtooth wave 136 and it has a duty cycle corresponding to the voltage level output of the D/A converter 128. During operation of the pulse generator 118 in the variable frequency mode, the frequency of the pulse train 146 is swept over the prescribed frequency band and the duty cycle is maintained constant during the frequency sweep at a value, for example, of sixty percent.

The variable frequency pulse train 146 produced by the comparator 142 of the pulse generator 118 is applied to one input of an AND gate 148 which has its output applied to a driver 152. The driver 152 produces a variable frequency switching pulse train 122 corresponding to pulse train 146 which is applied to the control input or gate of the test power switch 124. Accordingly, the test power switch 124 is switched on and off in synchronism with the switching pulse train 122. While the horn 10 is in the testing station 102, the power switch 64 of the horn is disabled from switching and is held in a closed condition, i.e. with the switch "on" for conducting current through the coil 70. This is provided by a disabling circuit 154 which applies a logic high voltage to the gate of the power switch 64 through a conductor connected with the junction of voltage divider resistors 156 and 158. The resistor 156 is provided on the circuit board of the control circuit 100 suitably and is suitably positioned adjacent the adjustable resistors 86 and 92 of the control circuit. The resistor 158 is also suitably provided on the circuit board of control circuit 100 and the voltage divider resistors are connected across the DC voltage source 126 in the testing station 102. After the testing is completed in station 102, the resistor 156 will be open circuited so as to remove the logic high voltage from the gate of power switch 64 and thereby enable it to operate in the switching mode under the control of control circuit 100.

With the test power switch 124 being switched on and off by the switching pulse train 122, the horn coil 70 is energized by voltage pulses applied thereto from the DC voltage source 126 at a varying frequency within the sweep frequency band with fixed duty cycle. During energization of the horn 60 through the sweep frequency band, the sound pressure level of the sound produced by the horn is sensed by the sensor, i.e. dB meter 112 so that the sound pressure level, as a function of energizing frequency, can be processed by the computer 108. The output of the dB meter 112 is applied through an A/D converter 164 to the input 162 of the computer 108. It will be understood that the sweep frequency band, as discussed above, is broad enough to include the resonant frequency of the diaphragm of the horn 60 at intermediate point within the upper and lower limits of the band. Accordingly, the sound pressure output level of the horn as represented by the signal applied to the computer input 162 will pass through a maximum value. The computer processes this signal to detect the occurrence of the peak or maximum value of the sound pressure level signal and upon such occurrence, the computer generates a trigger pulse at the computer output 166. This trigger pulse is applied to the other input of the AND gate 148 which causes its output to be held at logic low voltage during the remainder of the sweep frequency pulse train 146. The frequency of the pulse train 146 at the occurrence of the trigger pulse from the computer output 166 corresponds to the pulse frequency at the computer output 138. This value of pulse frequency is memorized as the resonant frequency of the diaphragm of the horn 60. Having thus determined the resonant frequency of the diaphragm of the horn 60, the horn is tested in the variable duty cycle mode at the resonant frequency to determine the maximum duty cycle which produces the desired sound quality.

In the variable duty cycle mode, the computer 108 produces a pulse frequency signal at output 138 which causes the pulse generator 118 to generate a constant frequency which is the memorized resonant frequency of the horn 60 being tested. The duty cycle of the pulse train 146 is varied over a predetermined range of values by varying the value of the pulse frequency at the computer output 144 in such manner that the duty cycle value is increased from the lower limit of the range to the upper limit. The range of duty cycle values is broad enough to include the duty cycle value which is high enough to cause impact of the horn plunger with the fixed pole piece with a large enough striking force to produce an undesired quality of sound. The range also includes duty cycle values which are low enough so that the diaphragm of the horn is vibrated freely without any impact of the plunger against the pole piece. The accelerometer 114 mounted on the housing 10 of the horn 60 produces an output signal corresponding to the force with which the plunger impacts the pole piece. This output signal is applied through an A/D converter 168 to the input 172 of the computer 108. When this force signal reaches a predetermined value, the value of the signal at computer output 144, which determines duty cycle, is memorized and the variable duty cycle mode of operation is terminated. The predetermined force signal value is selected to be at the threshold of striking force which produces an undesirable sound quality as determined by human listening tests on the class of horn being tested. Thus, the computer 108 memorizes, for the horn 60 under test, a duty cycle value which will produce an undesired sound quality. Accordingly, any higher value of duty cycle will also produce undesired sound quality. The duty cycle setting at the computer output 144 is reduced by a predetermined percentage, for example two percent, from the memorized impact threshold value and the reduced value is memorized by the computer as the operating duty cycle for the horn under test. The percentage reduction from the impact threshold value duty cycle is determined by testing many horns and is large enough to ensure that the operating duty cycle will not result in plunger impact even when the horn is operated in a vehicle at the upper limit of its rated voltage. (The duty cycle testing for a vibrator horn is different in that plunger impact is required and will be described subsequently.)

After the frequency testing and duty cycle testing as described above with the horn in the testing station 102, the horn is tested to determine whether it will draw an excessive amount of current. For this purpose, the pulse generator 118 is controlled by the computer 108 to operate at the horn resonant frequency and at the operating duty cycle. For this test, the DC voltage source 126 is set to apply a voltage to the coil of the horn 10 equal to the maximum rated voltage of the horn. The current sensor 116 develops an output signal which is applied through an A/D converter 174 to the computer input 176. The computer compares the value of the current signal at input 176 with a preset value equal to the maximum rated value for the horn under test. If the horn current is excessive, the horn is removed from the testing station 102 for repair and retesting. If the current drawn by the horn is not excessive, the horn is removed from the testing station 102 and placed in the horn adjusting station 104 which will be described presently.

The duty cycle testing of the vibrator horn differs from that described above for a seashell horn due to the requirement of plunger impact against the pole piece in a vibrator horn. The vibrator horn duty cycle testing is as follows. The test station 102 is operated in the variable duty cycle mode with the pulse generator 118 generating the memorized resonant frequency of the horn. The duty cycle of the pulse train 146 is varied over a range of values broad enough to include the duty cycle value which is high enough to cause impact of the horn plunger with the pole piece with a large enough striking force to produce an undesired quality of sound. The lower limit of the range is low enough to include a duty cycle value such that the diaphragm vibrates freely without impact of the plunger. The computer 108 compares the force signal at computer input 172, which is produced by the accelerometer 114 and A/D converter 168, with a predetermined value which is at the threshold of striking force which produces an undesirable sound quality. When the force signal equals the predetermined value, it is memorized and represents the predetermined operating duty cycle for the horn under test.

The test station 102 and the operation thereof has been described for both the seashell horn and the vibrator horn. The testing is the same for both horns except the duty cycle testing which has been described separately for the seashell horn and the vibrator horn.

The Horn Adjusting Station

The horn adjusting station 104 comprises a holding fixture 182 for the horn housing 10, a resistor trimming laser 184 and a trim computer 186 which controls the energization of a laser controller 188. An adjustable DC voltage source 190 is connected with the horn input terminal and the horn ground terminal is connected through a current sensor 194 to ground. The output of the current sensor 194 is connected to a pulse forming circuit 196 which, in turn, has its output connected to input terminal 198 of the trim computer. The predetermined resonant frequency and the predetermined operating duty cycle for the horn 60, as determined in the testing station 102, are transmitted from the computer 108 to the trim computer 186 via a communications bus 187. The horn housing 10 is held in the fixture 182 so that it will not vibrate during horn operation and the laser 184 is positioned with respect to the horn housing so that the beam of the laser can be selectively directed by the controller 188 through one or more holes in the housing to impinge upon the trimmable resistors 86, 92 and 156.

The adjusting station includes an electronic switch 192 which is connected with the control circuit 100 of the horn at the same point in the circuit as the manual horn switch 72 for on/off control of the horn in the adjusting station. The electronic switch 192 has its input connected with the output 193 of the trim computer 186.

The operation of the adjusting station 104 will now be described. The horn under test clamped in the holding fixture 182. Before the horn is electrically connected for energization from the adjustable DC voltage source 190 it is desirable to eliminate the effect of the disabling circuit 154 which held the power switch in the on condition in the test station 102. For this purpose, the computer 186 is operative under program control to operate the laser 184 to sever the voltage divider resistor 156 and thus remove the bias voltage from the input of the power switch 64. Then the horn under test is connected to the voltage source 190. The voltage source 190 is set to a voltage equal to the nominal voltage rating of the horn, for example, 12 volts.

After the disabling circuit 154 is open circuited by the laser operation, the trim computer 186 operates through its output 193 to turn on the switch 192 to blow the horn under the control of the control circuit 100. In this initial operating condition the horn coil 70 is energized with a pulse train having a frequency determined by the initial value of the trimmable resistor 86 and a duty cycle determined by the initial value of the trimmable resistor 92. The current flow through the horn coil is sensed by the current sensor 194 which produces a signal voltage having a pulse frequency and duty cycle corresponding to that of the energizing pulse current. This signal voltage is applied through the pulse forming circuit 196 to the input 198 of the trim computer. The pulse forming circuit 196 develops an output pulse train of rectangular pulses having the same frequency and pulse duration as the horn energizing pulses. The trim computer 186 processes the signal at input 198 and determines its frequency. The initial value of the resistor 86 is purposely set such that the frequency of the oscillator 78 and hence the frequency of the energizing pulse train will be higher than the resonant frequency of the horn diaphragm. The actual frequency of the horn energizing pulse train, as determined by the trim computer 186, is compared in the computer with the memorized resonant frequency for the horn under test as stored in the trim computer 186. After the comparison is made, the computer 186 switches the output 193 to turn off the horn. With the horn off, the computer 186, through its output 189 to the laser controller 188, causes the laser 184 to make a first cut to reduce the value of resistor 86 in accordance with difference between the actual frequency of the horn energizing pulse train and the memorized frequency for the horn. This process is repeated under control of the computer 186 until the actual frequency is equal to the memorized frequency.

After the memorized resonant frequency of the horn is set by trimming of resistor 86, the computer 186 compares the actual duty cycle of the horn energizing pulse train with the memorized predetermined operating duty cycle and determines the difference. The computer 186 turns off the horn and determines the amount of trimming to be made in the first cut on resistor 92. Under computer control, the laser controller 188 causes the laser to execute the first cut. This process is repeated under the control of the computer 186 until the actual duty cycle is substantially equal, i.e. within about one percent, to the predetermined operating duty cycle.

After the horn is adjusted as described above in the adjusting station 104, it is desirable to transfer it to another station (not shown) for final testing. In the final testing station, the horn is mounted so that it is free to vibrate. Supply voltage is applied and the horn is blown. The frequency, duty cycle, sound level output and current are measured and recorded for the horn. If the recorded data is within the specifications, the horn is good; otherwise, it is sent for repair.

Flow Chart

As described above, the computer 108 at the testing station 102 and the trim computer 186 at the adjusting station 104 are operated under program control. The control program for the computer 108 is represented by the flow chart of FIG. 5 and the control program of the trim computer 186 is represented by the flow chart of FIG. 6.

Figure 5:
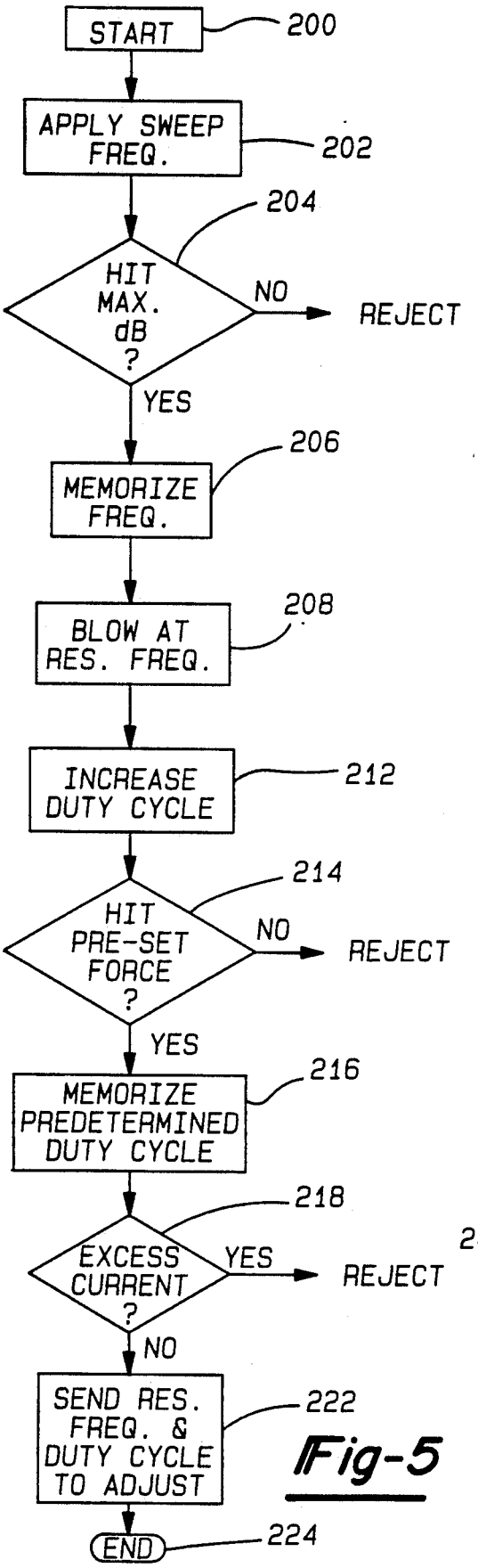
FIG. 5 is a flow chart of the computer control program for the testing station.

Referring now to FIG. 5, the horn testing program will be described. At the start block 200, the horn under test is energized under the control of the test station 102. The program advances to block 202 which applies the sweep frequency pulse train at constant duty cycle to the horn. At block 204, the computer determines whether the sound pressure level is at a maximum value. If not, the program loops back to block 202. If it is, the program advances to block 206 which memorizes the frequency at which maximum sound pressure level was achieved. Next, at block 208, the horn is energized at the memorized frequency, which is the resonant frequency of the horn, and at a predetermined low value of duty cycle. Next, at block 212, the duty cycle is increased over a predetermined range. With the duty cycle increasing, block 214 determines whether a predetermined impact force of the horn plunger is detected. If not, the horn is rejected for repair. If the predetermined impact force was detected at block 214 the program advances to block 216 which sets and memorizes the operating duty cycle for the horn. (In the case of a seashell horn, the operating duty cycle is set at a predetermined percent below the duty cycle at which the predetermined impact force was detected in block 214. In the case of the vibrator horn, the operating duty cycle is set at the value at which the predetermined impact force was detected.) From block 216, the program advances to block 218 which determines whether the horn current is excessive. If it is, the horn is sent for repair. If it is not excessive, the block 222 sends the predetermined resonant frequency and the predetermined operating duty cycle to the horn adjusting station computer 186. The program is ended at block 224.

Figure 6:
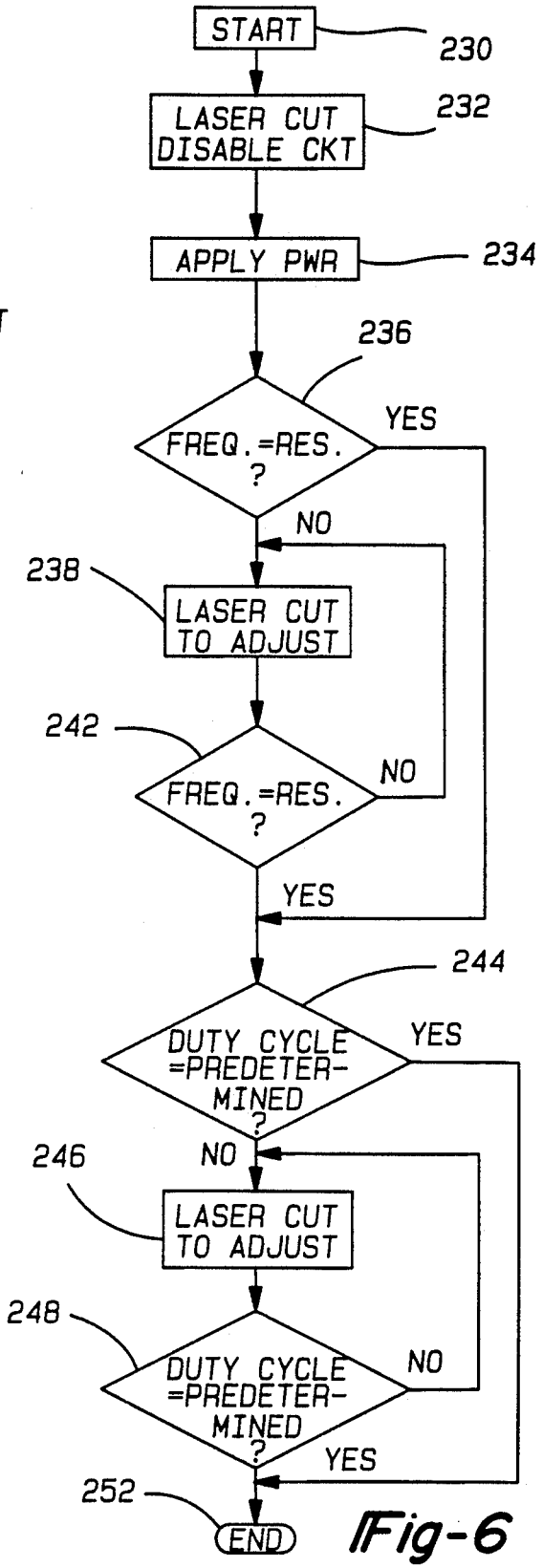
FIG. 6 is a flow chart of the computer control program for the adjusting station.

The control program of the trim computer 186 in adjusting station 104 will now be described with reference to the flow chart of FIG. 6. At the start block 230, the computer 186 has memorized the predetermined resonant frequency and the predetermined operating duty cycle as transmitted to it from the computer 108 for the horn under test. In block 232, the disabling circuit 232 is cut by the laser so that the horn under test is controlled by its own control circuit. At block 234 power is supplied to the horn and the horn is blown under control of its control circuit 100. In block 236, the actual horn frequency is compared with the memorized resonant frequency of the horn and if they are equal, the program advances to block 244; if they are not equal, the program advances to block 238 which makes a laser cut of resistor 86 to decrease the frequency of the energizing pulse train. Then, the program advances to block 242 which determines whether the horn frequency is equal to the memorized resonant frequency. If it is not, the program loops back to block 238. If it is, the program advances to block 244 which compares the actual duty cycle with the predetermined operating duty cycle and if they are equal, the program advances to the end block 252. If they are not equal, the program advances to block 246 which makes the laser cut of the resistor 92 to adjust the duty cycle. Then, at block 248 it is determined whether the actual duty cycle of the horn is equal to the predetermined operating duty cycle. If it is not, the program loops back to block 246. If it is, the program advances to the end block 252.

Although the description of this invention has been given with reference to a particular embodiment, it is not to be construed in the limiting sense. Many variations and modifications will now occur to those skilled in the art. For a definition of the invention reference is made to the appended claims.

What is claimed is:

1. The method of adjusting a vehicle horn having an electronic horn energizing circuit, a diaphragm assembly having a resonant frequency of vibration and an electromagnet including a drive coil energized by said energizing circuit, said energizing circuit generating a DC pulse train for vibrating said diaphragm, said method comprising the steps of:

energizing said coil from a test energizing circuit with a pulse train of varying frequency over a sweep frequency band which includes said resonant frequency, determining the frequency at which the maximum sound pressure level is produced by said horn to identify its resonant frequency, energizing said coil from said test energizing circuit with a pulse train frequency equal to said resonant frequency and varying the duty cycle over a range of values which includes a certain duty cycle which causes a predetermined impact force of said diaphragm assembly with a fixed member of the horn, operating the horn by energizing the coil with said horn energizing circuit, adjusting the horn energizing circuit to cause it to generate a pulse train at said resonant frequency, and adjusting said horn energizing circuit to cause it to generate a pulse train at said resonant frequency with an actual duty cycle having a known relationship with said certain duty cycle.

2. The invention as defined in claim 1 wherein said horn is a seashell horn and wherein:

said second-mentioned step of adjusting said energizing circuit includes reducing the duty cycle by a predetermined amount to establish said known relationship so that said diaphragm assembly does not impact said fixed member.

3. The invention as defined in claim 1 wherein said known relationship between said actual duty cycle and said certain duty cycle is substantially equality.

4. The invention as defined in claim 1 wherein said vehicle horn includes a housing, said diaphragm assembly being mounted on the housing and including a diaphragm carrying a magnetic plunger, a pole piece and said driving coil being supported by the housing for magnetically attracting said plunger, a power switch for connecting said drive coil in circuit with a voltage source, said energizing circuit including a control circuit for generating a DC pulse train for switching the power switch on and off, said control circuit including first and second adjustable circuit elements for setting the frequency and the duty cycle, respectively, of said pulse train, and wherein:

the first-mentioned step of adjusting said energizing circuit includes adjusting the first adjustable element, and the second-mentioned step of adjusting the energizing circuit includes the step of adjusting the second adjustable circuit element.

5. The invention as defined in claim 4 wherein:

said first and second circuit elements are resistors and the steps of adjusting said first and second circuit elements are carried out by laser trimming.

6. Apparatus for adjusting a vehicle horn of the type comprising a housing, a diaphragm on the housing and carrying a magnetic plunger, a pole piece and a driving coil supported by the housing for magnetically attracting said plunger, a power switch for connecting said drive coil in a circuit with a voltage source, the diaphragm and the mass carried thereby having a resonant frequency of vibration, a horn control circuit for generating a DC pulse train for switching the power switch on and off, said control circuit including first and second adjustable elements for setting the frequency and the duty cycle, respectively of said pulse train, said apparatus comprising:

a test energizing circuit which is operable in a variable frequency mode and in a variable duty cycle mode, means for coupling said test energizing circuit with said coil, means for operating said test energizing circuit in said variable frequency mode over a frequency range including said resonant frequency, means for measuring the sound pressure level produced by said horn during operation over said frequency range and for memorizing the frequency which produces maximum sound pressure level, means for operating said test energizing circuit in said variable duty cycle mode at said memorized frequency over a predetermined range of increasing duty cycle variation, means for detecting the impact of said plunger with said pole piece with a predetermined force, and means for memorizing the duty cycle which produced the impact of the plunger with the pole piece.

7. The invention as defined in claim 6 including:

means for adjusting said first circuit element for setting the frequency of said pulse train equal to said resonant frequency, and means for adjusting said second adjustable element for setting the duty cycle equal to an operating duty cycle.

8. The invention as defined in claim 7 wherein said first and second adjustable elements are laser trimmable resistors, and wherein:

said first adjusting means and said second adjusting means is a laser for trimming said resistors.

9. The method of adjusting a vehicle horn of the type comprising a housing, a diaphragm mounted on the housing and carrying a magnetic plunger, a pole piece and a driving coil supported by the housing for magnetically attracting said plunger, a power switch for connecting said drive coil in circuit with a voltage source, the diaphragm and the mass carried thereby having a resonant frequency of vibration, a horn control circuit for generating a DC pulse train for switching the power switch on and off, said control circuit including first and second adjustable circuit elements for setting the frequency and the duty cycle, respectively, of said pulse train, said method comprising the steps of:

coupling with said coil a test energizing circuit which is operable in a variable frequency mode and in a variable duty cycle mode to energize said driving coil, operating said test energizing circuit in said variable frequency mode with varying frequency and measuring the sound level produced by said horn and memorizing the frequency at which maximum sound pressure level is produced, operating said test energizing circuit in said variable duty cycle mode at the memorized frequency with varying duty cycle and memorizing a duty cycle value which is in known relation to that which causes said plunger to impact said pole piece with a predetermined force, uncoupling said test energizing circuit from said coil after memorizing the memorized frequency and the memorized duty cycle, operating the horn by energizing said drive coil under control of said horn control circuit, adjusting the first adjustable circuit element to cause the horn control circuit to produce a pulse train at the memorized frequency, and adjusting the second adjustable element to cause the horn control circuit to produce a pulse train with a duty cycle value which is in predetermined relation to the memorized duty cycle.

10. The method of adjusting a vehicle horn having an electronic energizing circuit, said method comprising the steps of:

energizing said horn with a variable frequency pulse train over a frequency range that includes a resonant frequency of vibration of said horn, measuring the sound level produced by said horn as it is energized over said frequency range, determining the frequency of said pulse train which produces the maximum sound level output from said horn, adjusting said energizing circuit to generate a pulse train at the determined frequency, and adjusting said energizing circuit to set the duty cycle of said pulse train at a selected value which produced a desired quality of sound output from said horn at the determined frequency.

11. The invention as defined in claim 10, wherein said energizing step further comprises energizing said horn from a test energizing circuit.

12. The invention as defined in claim 11, wherein said energizing step further comprises controlling said test energizing circuit with a computer having a microprocessor operating under program control and a memory in which said frequency range is stored.

13. The invention as defined in claim 10, further comprising, prior to said second-mentioned step of adjusting said energizing circuit, the steps of:

energizing said horn with a pulse train having a frequency equal to said resonant frequency, and varying the duty cycle over a range of values to determine said selected value of the duty cycle.

14. The invention as defined in claim 13, wherein said energizing steps further comprise controlling said pulse train via a microprocessor operating under program control.

15. The invention as defined in claim 10, wherein said first-mentioned step of adjusting said energizing circuit further comprises:

operating said electronic energizing circuit to determine the actual frequency of the pulses generated by said energizing circuit, and adjusting said energizing circuit to generate a pulse train at the determined frequency in accordance with the deviation of said actual frequency from the determined frequency.

16. The invention as defined in claim 15, wherein said second-mentioned step of adjusting said energizing circuit further comprises:

operating said electronic energizing circuit to determine the actual duty cycle of the pulses generated by said energizing circuit, and adjusting said energizing circuit to set the duty cycle of aid pulse train to said selected value in accordance with the deviation of said actual duty cycle from said selected value.

17. The invention as defined in claim 16, further comprising carrying out said first and second-mentioned adjusting steps under the control of a microprocessor.

* * * * *

UNITED STATES PATENT AND TRADEMARK OFFICE

CERTIFICATE OF CORRECTION

PATENT NO. : 5,266,921

DATED : November 30, 1993

INVENTOR(S) : Wilson, Carl R.

It is certified that error appears in the above-identified patent and that said Letters Patent is hereby corrected as shown below:

Title page, item [57],
Abstract line 4, delete "and the", first instance.

Line 8, after "cycle", first instance, add -- and the --.

Column 16, line 32, delete "aid" and insert -- said --.

Signed and Sealed this

Thirtieth Day of July, 1996

Bruce Lehman

*Attest:*

BRUCE LEHMAN

*Attesting Officer*

*Commissioner of Patents and Trademarks*